US008726664B2

(12) United States Patent
Narazaki et al.

(10) Patent No.: US 8,726,664 B2
(45) Date of Patent: May 20, 2014

(54) ENGINE LUG-DOWN SUPPRESSING DEVICE FOR HYDRAULIC WORK MACHINERY

(75) Inventors: Akihiro Narazaki, Tsuchiura (JP); Nobuei Ariga, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 354 days.

(21) Appl. No.: 13/058,721

(22) PCT Filed: Aug. 11, 2009

(86) PCT No.: PCT/JP2009/064190
§ 371 (c)(1),
(2), (4) Date: Feb. 11, 2011

(87) PCT Pub. No.: WO2010/018828
PCT Pub. Date: Feb. 18, 2010

(65) Prior Publication Data

US 2011/0146283 A1 Jun. 23, 2011

(30) Foreign Application Priority Data

Aug. 14, 2008 (JP) ..... 2008-209017

(51) Int. Cl.
*F02D 25/02* (2006.01)

(52) U.S. Cl.
USPC ..... 60/701

(58) Field of Classification Search
USPC ..... 60/701
See application file for complete search history.

(56) References Cited

U.S. PATENT DOCUMENTS 4,614,592 A * 9/1986 Googin et al. ..... 210/679
5,307,631 A * 5/1994 Tatsumi et al. ..... 60/452
6,010,309 A * 1/2000 Takamura et al. ..... 417/22
6,308,516 B1 10/2001 Kamada (Continued)

FOREIGN PATENT DOCUMENTS

EP 0 522 171 A1 1/1993
EP 1 666 734 A1 6/2006

(Continued)

OTHER PUBLICATIONS

English translation is produced by machine translation of JP, 2005-163913.*

(Continued)

*Primary Examiner* — Thomas Denion
*Assistant Examiner* — Shafiq Mian
(74) *Attorney, Agent, or Firm* — Crowell & Moring LLP

(57) ABSTRACT

To provide an engine lug-down suppressing device for hydraulic work machinery, capable of suppressing deterioration in operability of a hydraulic actuator when the hydraulic actuator is caused to operate quickly from a stopped state. Pilot pressure to a tilting control unit of a variable displacement hydraulic pump is controlled by a solenoid valve. A controller controls the solenoid valve in accordance with a target rotational speed signal from an input unit. This control differs according to whether or not a detector detects the pilot pressure created by an operating lever device. In an entire range of the target engine rotational speed, pump absorption torque at the time when the pilot pressure is not detected, falls within a range equal to or smaller than pump absorption torque at the time when the pilot pressure is detected, and is set to approach the pump absorption torque at the time when the pilot pressure is detected with an increase in the target engine rotational speed.

4 Claims, 7 Drawing Sheets

(56) References Cited

U.S. PATENT DOCUMENTS

| | | | | |
|---|---|---|---|---|
| 7,856,951 | B2 * | 12/2010 | Kamado et al. | 123/41.49 |
| 8,266,903 | B2 * | 9/2012 | Kowatari et al. | 60/449 |
| 2006/0191732 | A1 * | 8/2006 | Lunzman et al. | 180/307 |

FOREIGN PATENT DOCUMENTS

| | | | |
|---|---|---|---|
| JP | 5-79502 | A | 3/1993 |
| JP | 8-296602 | A | 11/1996 |
| JP | 10-220359 | A | 8/1998 |
| JP | 2000-154803 | A | 6/2000 |
| JP | 2005-163913 | * | 6/2005 |
| JP | 2005-163913 | A | 6/2005 |
| JP | 2006-177560 | A | 7/2006 |

OTHER PUBLICATIONS

International Search Report dated Nov. 17, 2009 with English translation (four (4) pages).
Extended European Search Report dated Dec. 18, 2012 (Seven (7) pages).

* cited by examiner

ENGINE LUG-DOWN SUPPRESSING DEVICE FOR HYDRAULIC WORK MACHINERY

TECHNICAL FIELD

The present invention relates to an engine lug-down suppressing device for hydraulic work machinery, provided on the hydraulic work machinery, such as a construction machine, in which a variable displacement hydraulic pump is driven by an internal combustion engine, such as a diesel engine, to drive a hydraulic actuator with discharge oil of the variable displacement hydraulic pump, for suppressing lug-down of the engine associated with operation of the hydraulic actuator.

BACKGROUND ART

In general, diesel engines are used as engines for hydraulic excavators included in the hydraulic work machinery. In the diesel engine, speed control is performed. In the speed control, when an actually detected engine rotational speed (hereinafter referred to as "actual engine rotational speed") becomes lower than a target engine rotational speed with an increase in engine load, a fuel injection quantity is controlled so as to cause the actual engine rotational speed to approach the target engine rotational speed.

In hydraulic excavators, a variable displacement hydraulic pump is driven by the diesel engine to drive a hydraulic actuator, such as an arm cylinder, with discharge oil of the variable displacement hydraulic pump. Therefore, when pump discharge pressure increases with operation of the hydraulic actuator, the engine load increases and the actual engine rotational speed decreases. When the actual engine rotational speed decreases in this manner, the above-described speed control is performed. The speed control has a delay in response to a decrease in the actual engine rotational speed, thereby causing, a phenomenon in which the actual engine rotational speed decreases during a response time period, that is, lug-down of the engine. The quicker the operation of the hydraulic actuator from a stopped state, in other words, the more sudden an increase in pump absorption torque, the more likely the lug-down of the engine is to increase.

In the past, lug-down of the engine has been suppressed by controlling the pump absorption torque at the time when an operating lever device, serving as operation instruction means for giving an instruction to cause the hydraulic actuator to operate, is non-operated, and the pump absorption torque at the time when the operating lever device is operated (see Patent Literatures 1 and 2).

CITATION LIST

Patent Literature

Patent Literature 1: JP-A No. 2005-163913
Patent Literature 2: JP-A No. 2000-154803

SUMMARY OF INVENTION

Technical Problem

By the way, the operating speed of the hydraulic actuator changes depending on the discharge flow rate of the variable displacement hydraulic pump. Therefore, at first, the pump discharge flow rate at the start of operation of the hydraulic actuator becomes smaller than a pump discharge flow rate corresponding to the manipulation of the operating lever device with a decrease in the actual engine rotational speed due to lug-down of the engine, and then increases to the pump discharge flow rate corresponding to the manipulation of the operating lever device with an increase of the actual engine rotational speed to close to the target engine rotational speed by the speed control. The quicker the operation of the hydraulic actuator from a stopped state, the greater the variation in the pump discharge flow rate.

In the above-described known art, control is performed such that, when the operating lever device is non-operated, the pump absorption torque is always held at a preset small absorption torque, that is, a minimum pump absorption torque for performance of the variable displacement hydraulic pump, or a lower limit of a pump absorption torque preset larger than the minimum pump absorption torque. This control is performed regardless of the engine rotational speed. Therefore, in a state in which the engine is operating in a range of the engine rotational speed capable of producing a sufficient engine output torque for a maximum pump absorption torque, when, for example, the operating lever device is quickly operated to a maximum manipulated variable from the non-operated state to thereby cause a sudden and large increase in the pump absorption torque, this sudden and large increase in the pump absorption torque, combined with the above-described variation in the pump discharge flow rate, leads to a deterioration in operability of the hydraulic actuator. In other words, the hydraulic actuator, at the start of its operation from a stopped state, behaves in a deviating and erratic manner with respect to the manipulation of the operating lever device.

Accordingly, the present invention has been made in view of the foregoing, and an object of the present invention is to provide an engine lug-down suppressing device for hydraulic work machinery, capable of suppressing deterioration in operability of a hydraulic actuator when the hydraulic actuator is caused to operate quickly from a stopped state.

Solution To Problem (1) In order to accomplish the above-mentioned object, an engine lug-down suppressing device for hydraulic work machinery according to the present invention is characterized in that the engine lug-down suppressing device is provided on the hydraulic work machinery including: an engine; a variable displacement hydraulic pump that is driven by the engine; a hydraulic actuator that is driven by discharge oil of the variable displacement hydraulic pump; operation instruction means for giving an instruction to cause the hydraulic actuator to operate; and target engine rotational speed instruction means for giving an instruction on a target engine rotational speed of the engine, and includes: detection means for detecting the presence or absence of an instruction by the operation instruction means; and pump absorption torque control means for controlling pump absorption torque of the variable displacement hydraulic pump in accordance with a detection result by the detection means, wherein the pump absorption torque control means is set to serve as first control means for controlling pump absorption torque in accordance with the target engine rotational speed when no instruction is detected by the detection means, and second control means for controlling pump absorption torque in accordance with the target engine rotational speed when an instruction is detected by the detection means, and wherein the pump absorption torque determined by the first control means falls within a range equal to or smaller than the pump absorption torque determined by the second control means in an entire range of the target engine rotational speed, and is set to approach the pump absorption torque determined by the second control means with an increase in the target engine rotational speed.

According to the present invention configured in this manner, when no instruction is detected by the detection means, the first control means controls pump absorption torque in accordance with the target engine rotational speed. At this time, the pump absorption torque determined by the first control means is controlled within a range equal to or smaller than the pump absorption torque determined by the second control means in the entire range of the target engine rotational speed, and is also controlled so as to approach the pump absorption torque determined by the second control means with an increase in the target engine rotational speed. Thus, in a state in which the engine is operating in a range of the engine rotational speed capable of producing a sufficient engine output torque for the maximum pump absorption torque, the pump absorption torque in a stopped state of the hydraulic actuator can be caused to approach the pump absorption torque at the start of operation of the hydraulic actuator, thereby enabling reduction of an increase in the pump discharge flow rate when the hydraulic actuator is caused to operate quickly from the stopped state. It is therefore possible to suppress deterioration in operability of the hydraulic actuator when the hydraulic actuator is caused to operate quickly from the stopped state.

(2) The engine lug-down suppressing device for the hydraulic work machinery described in (1) may be characterized by including water temperature detecting means for detecting temperature of engine cooling water for cooling the engine, and correction means for correcting the pump absorption torque determined by the first control means in accordance with the engine cooling water temperature detected by the water temperature detecting means.

(3) The engine lug-down suppressing device for the hydraulic work machinery described in (1) or (2) may be characterized by including oil temperature detecting means for detecting temperature of working oil to serve as discharge oil of the variable displacement hydraulic pump, and correction means for correcting the pump absorption torque determined by the first control means in accordance with the working oil temperature detected by the oil temperature detecting means.

Advantageous Effects of Invention

According to the present invention, it is possible to provide an engine lug-down suppressing device for hydraulic work machinery, capable of suppressing deterioration in operability of a hydraulic actuator when the hydraulic actuator is caused to operate quickly from a stopped state.

DESCRIPTION OF EMBODIMENTS

Figure 1:
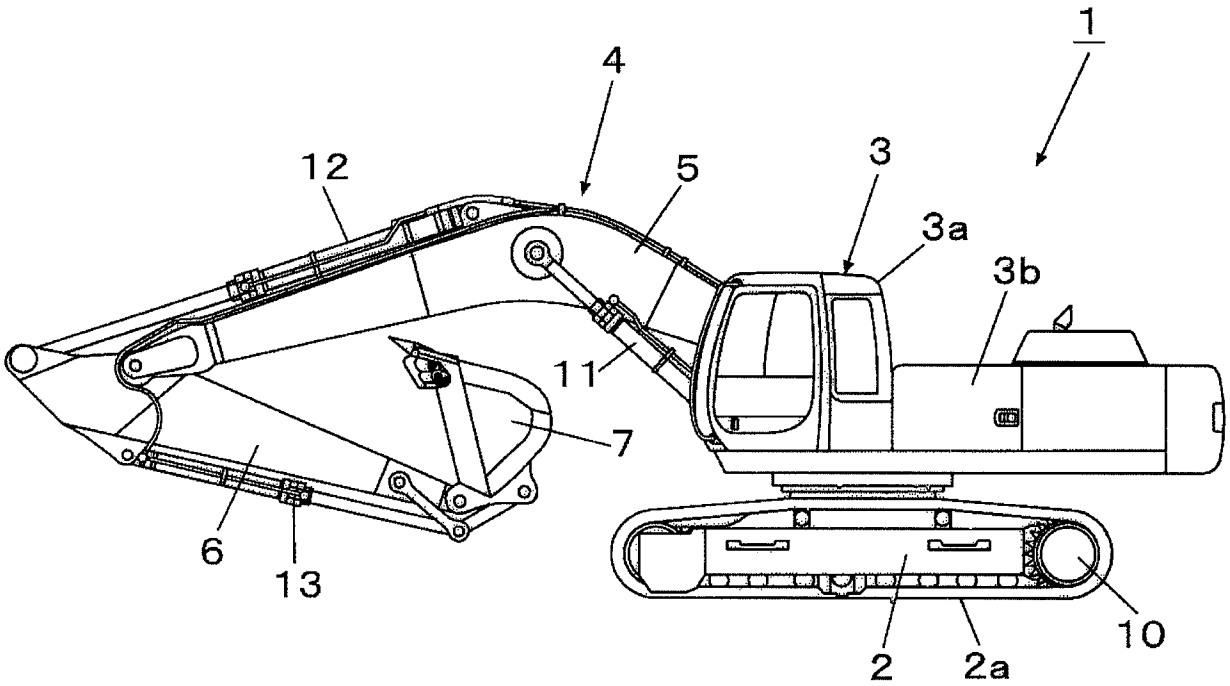
FIG. 1 is a left side view of a hydraulic excavator provided with an engine lug-down suppressing device for hydraulic work machinery according to one embodiment of the present invention.

Firstly, a hydraulic excavator provided with an engine lug-down suppressing device for hydraulic work machinery according to one embodiment of the present invention will be described using FIG. 1. FIG. 1 is a left side view of the hydraulic excavator provided with the engine lug-down suppressing device for hydraulic work machinery according to one embodiment of the present invention.

As shown in FIG. 1, the hydraulic excavator 1 includes a traveling body 2 that travels by driving a crawler belt 2*a*, a revolving superstructure 3 rotatably provided on the traveling body 2 and including an operator's cab 3*a* and a machinery house 3*b*, and a front working machine 4 provided at a front central portion of the revolving superstructure 3. The traveling body 2 includes, as a power source, a traveling motor 10 composed of a hydraulic motor on both sides. Also, the revolving superstructure 3 includes, as a power source, a revolving motor (not shown) composed of a hydraulic motor.

The front working machine 4 includes a boom 5 joined to a front central portion of the revolving superstructure 3 in a vertically rotatable manner, an arm 6 rotatably joined to the end of the boom 5 opposite to the revolving superstructure 3, and a bucket 7 rotatably joined to the end of the arm 6 opposite to the boom 5. The boom 5, the arm 6, and the bucket 7 are respectively driven by a boom cylinder 11, an arm cylinder 12, and a bucket cylinder 13 which are composed of hydraulic cylinders.

Figure 2:
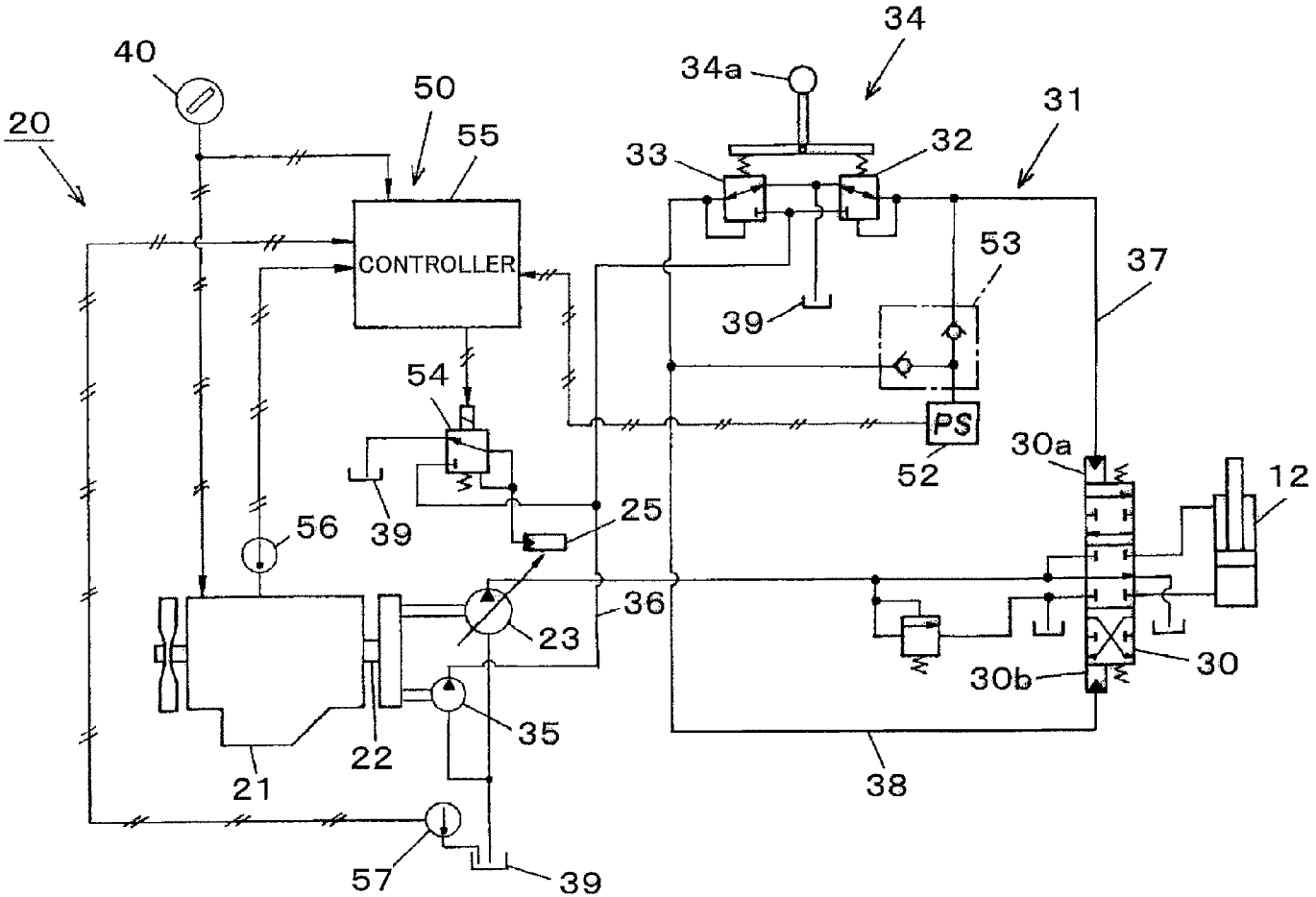
FIG. 2 is a simplified hydraulic circuit diagram of a hydraulic control system provided on the hydraulic excavator shown in FIG. 1, including the engine lug-down suppressing device for hydraulic work machinery according to one embodiment of the present invention.
Figure 3:
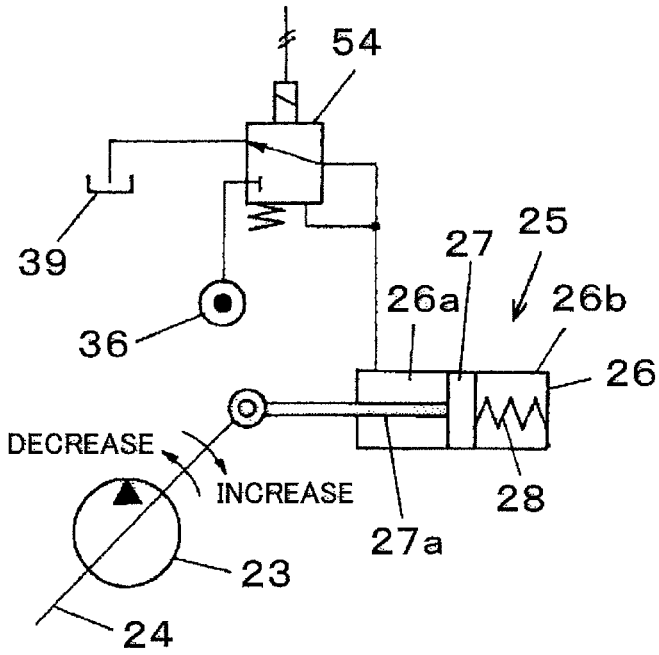
FIG. 3 is a detailed hydraulic circuit diagram of a tilting control unit of a variable displacement hydraulic pump shown in FIG. 2.

Next, a hydraulic control system of the hydraulic excavator 1 including the engine lug-down suppressing device for hydraulic work machinery according to one embodiment of the present invention will be described using FIGS. 2 and 3. FIG. 2 is a simplified hydraulic circuit diagram of the hydraulic control system provided on the hydraulic excavator shown in FIG. 1, including the engine lug-down suppressing device for hydraulic work machinery according to one embodiment of the present invention. FIG. 3 is a detailed hydraulic circuit diagram of a tilting control unit of a variable displacement hydraulic pump shown in FIG. 2.

The hydraulic control system 20 is configured to be able to drive all the above plural hydraulic actuators, namely, the two traveling motors 10, the revolving motor, the boom cylinder 11, the arm cylinder 12, and the bucket cylinder 13. However, for ease of explanation, an illustration and description will be given only of the elements for driving the arm cylinder 12, among those hydraulic actuators.

The hydraulic control system 20 includes an engine (diesel engine) 21, the variable displacement hydraulic pump 23 as a main pump which is driven by power transmitted from the engine 21 through a transmission 22, a hydraulic-pilot-operated directional control valve 30 interposed between the variable displacement hydraulic pump 23 and the arm cylinder 12 for controlling the flow of pressure oil supplied to the arm cylinder 12 from the variable displacement hydraulic pump 23, and a pilot circuit 31 for operating the directional control valve 30.

The directional control valve 30 includes hydraulic pilot portions 30*a* and 30*b* for operating a spool (not shown) in the two opposing directions. The pilot circuit 31 includes a pair of pilot-operated pressure reducing valves 32 and 33, an operating lever device 34 allowing selective operation of the pair of pressure reducing valves 32 and 33 with an operating lever 34*a*, and a pilot pump 35 driven by power transmitted from the engine 21 through the transmission 22 to discharge pilot pressure oil to be supplied to the pressure reducing valves 32 and 33. The discharge oil of the pilot pump 35 is guided to inlet ports of the pressure reducing valves 32 and 33 through a primary pressure line 36. An outlet port of the pressure reducing valve 32 and the hydraulic pilot portion 30*a* at one end of the directional control valve 30 communicate with each other through a pilot line 37. An outlet port of the pressure reducing valve 33 and the hydraulic pilot portion 30*b* at the other end of the directional control valve 30 communicate with each other through a pilot line 38. In the pilot circuit 31 configured in this manner, in response to the tilting of the operating lever 34*a* of the operating lever device 34, pilot pressure is produced by the pressure reducing valve 32 or 33 to be guided to the hydraulic pilot portion 30*a* or 30*b* of the directional control valve 30 through the pilot line 37 or 38. Thus, the directional control valve 30 switches, so that the flow of pressure oil supplied to the arm cylinder 12 from the variable displacement hydraulic pump 23 is controlled. In other words, the pilot circuit 31 constitutes operation instruction means for giving an instruction to cause the arm cylinder 12 to operate.

Also, the hydraulic control system 20 includes an input unit 40 as target engine rotational speed instruction means for giving a target engine rotational speed instruction to the engine 21. As described in Background Art, the engine 21 is adapted to perform the speed control in which, when an actual engine rotational speed becomes lower than a target engine rotational speed with an increase in engine load, a fuel injection quantity is controlled so as to cause the actual engine rotational speed to approach the target engine rotational speed.

The variable displacement hydraulic pump 23 is an axial piston pump, such as a swash plate variable displacement hydraulic pump, allowing tilting control, and is provided with a tilting control unit 25 for controlling a tilt angle of a swash plate 24. The tilting control unit 25 includes a cylinder bore 26, a piston 27 that includes a piston rod 27*a* coupled to the swash plate 24 and reciprocates within the cylinder bore 26, and a biasing spring 28 for urging the piston 27 in a direction to compress a rod-side chamber 26*a* of the cylinder bore 26. Inside the cylinder bore 26, pressure oil is supplied to the rod side chamber 26*a*, thereby allowing the piston 27 to move while compressing a bottom-side chamber 26*b* against the biasing spring 28, and, with a decrease in pressure in the rod-side chamber 26*a*, the piston 27 is forced back by the biasing spring 28 to move in the direction to compress the rod-side chamber 26*a*. In response to movement of the piston 27 in the direction to compress the bottom-side chamber 26*b*, the swash plate 24 is tilted in a displacement increasing direction. On the other hand, in response to movement of the piston 27 in the direction to compress the rod-side chamber 26*a*, the swash plate 24 is tilted in a displacement decreasing direction.

Figure 4:
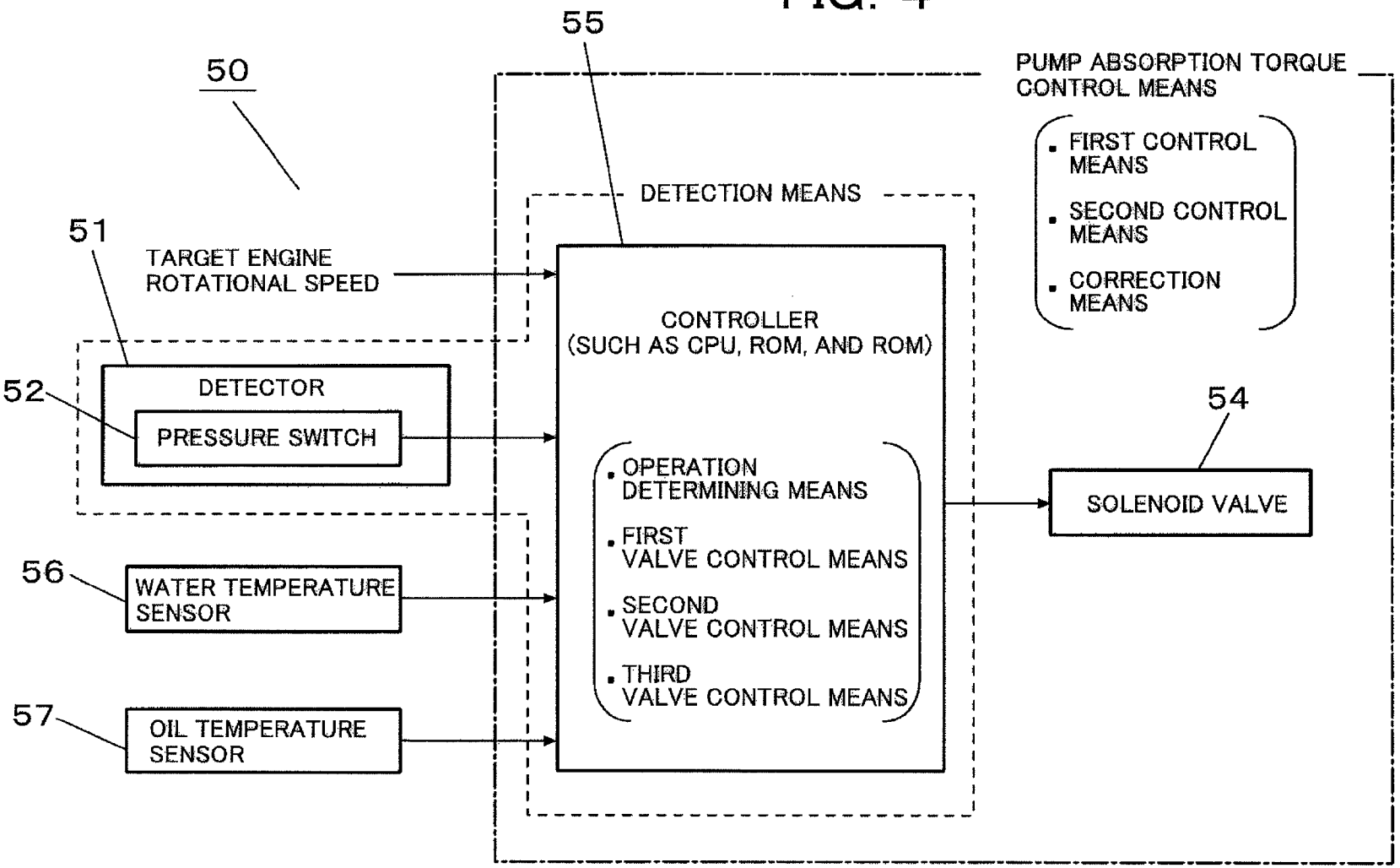
FIG. 4 is a block diagram of the engine lug-down suppressing device for hydraulic work machinery according to one embodiment of the present invention.
Figure 5:
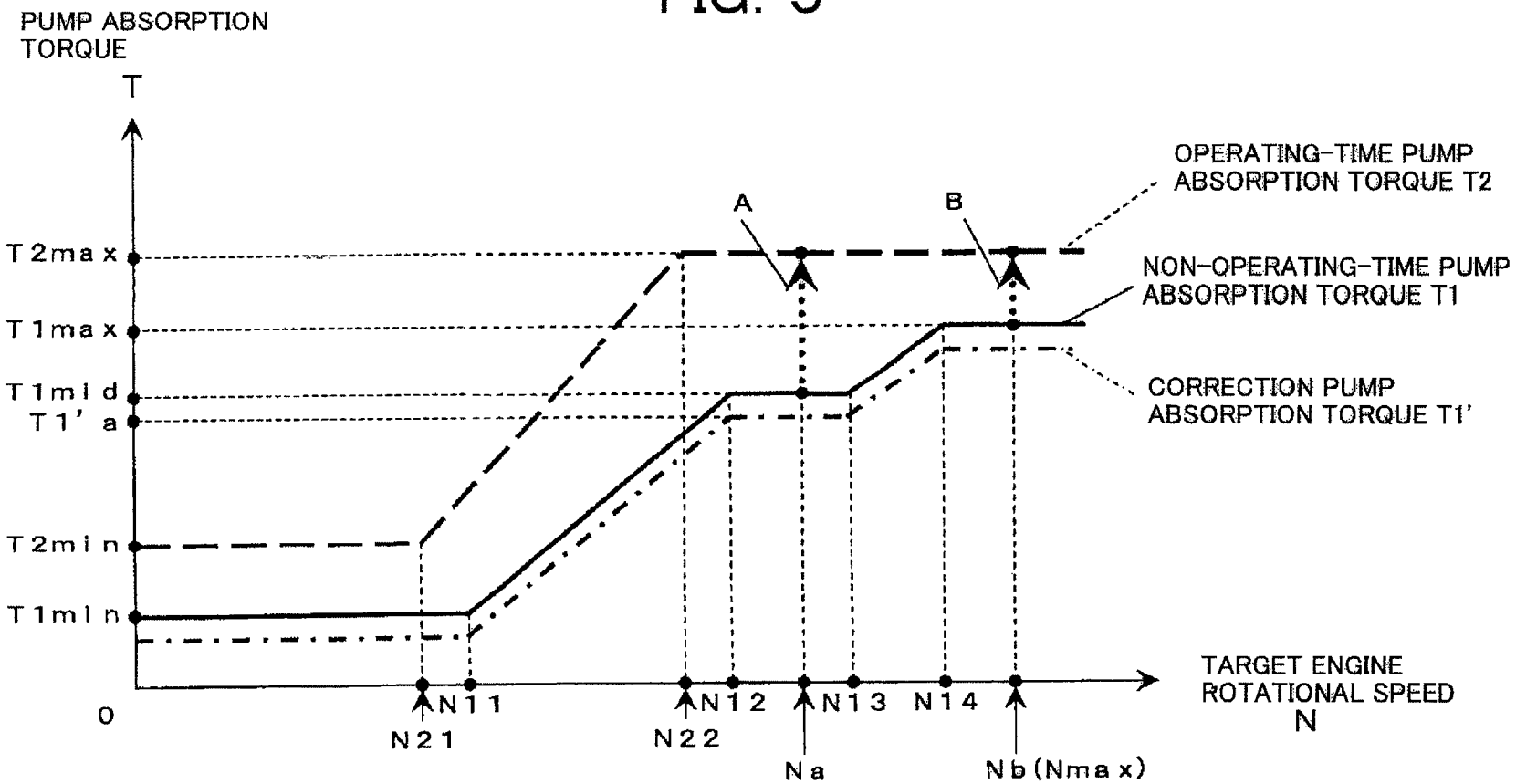
FIG. 5 is a diagram showing the relationship between a target engine rotational speed previously stored in a controller shown in FIG. 4 and a pump absorption torque.
Figure 6:
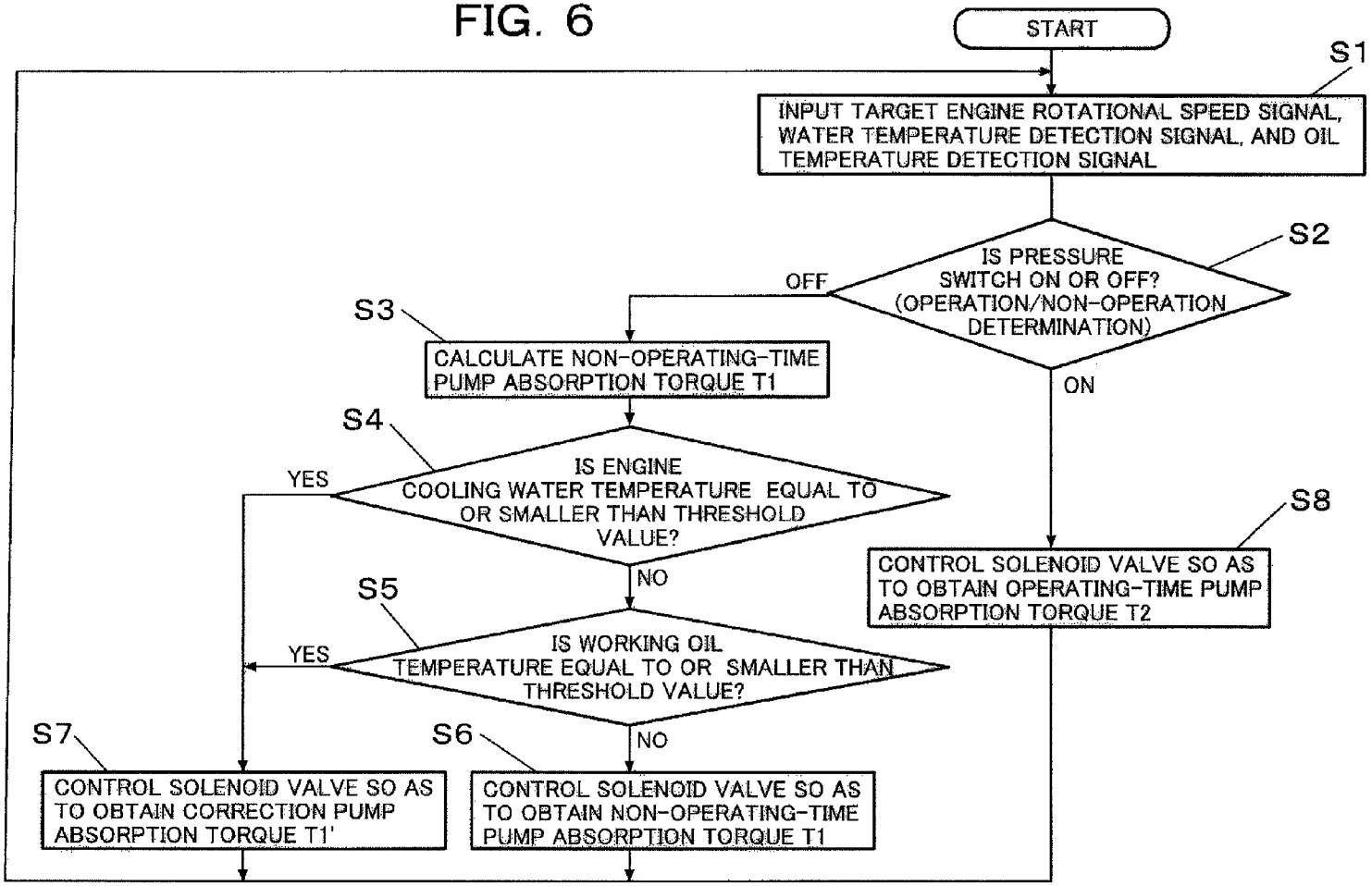
FIG. 6 is a flowchart showing a procedure performed by the controller shown in FIG. 4.
Figure 7:
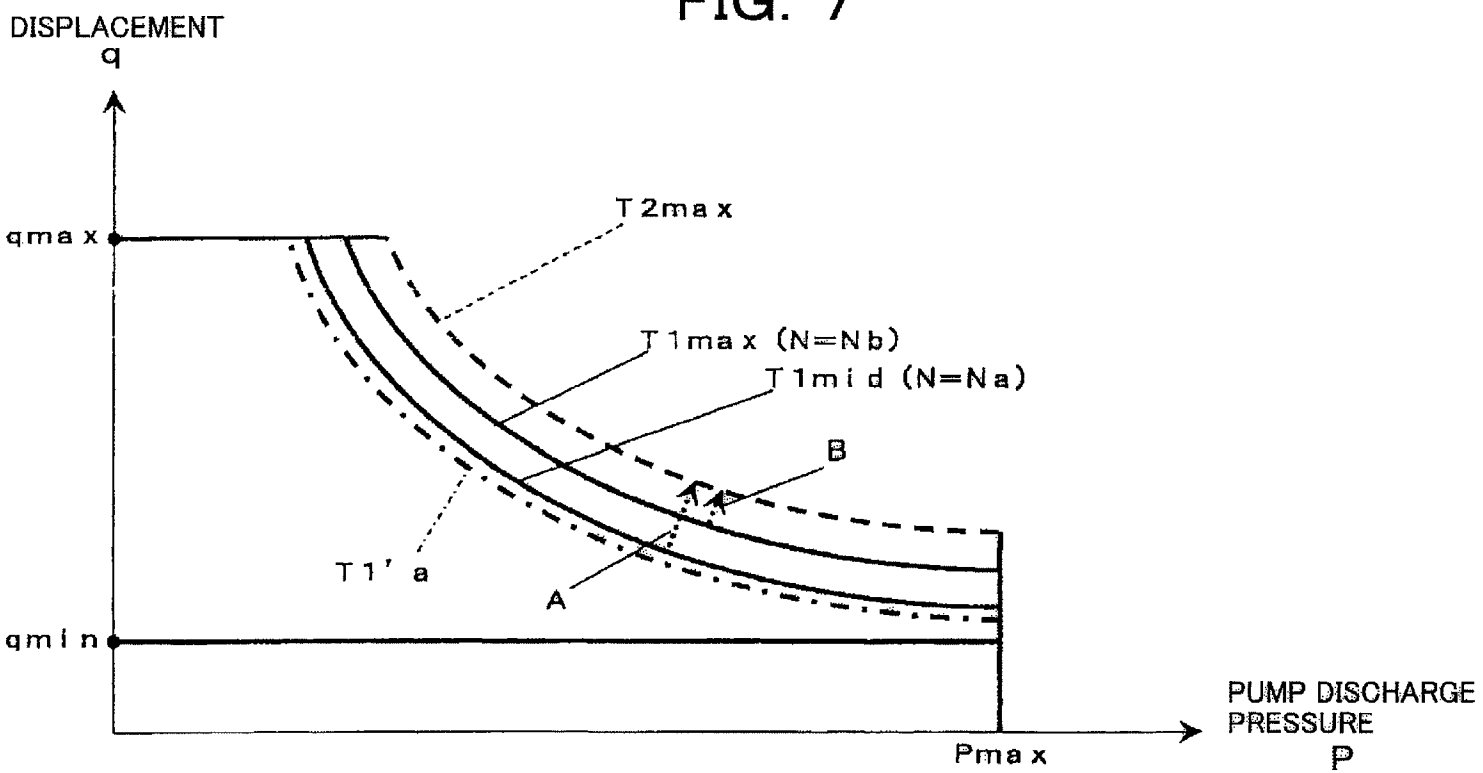
FIG. 7 is a diagram showing the relationship between the characteristics of torque constant control that is performed with respect to the variable displacement hydraulic pump shown in FIG. 2 and the various pump absorption torques shown in FIG. 6.

Next, the engine lug-down suppressing device according to the embodiment will be described using FIGS. 4 to 7, in addition to FIGS. 2 and 3 described above. FIG. 4 is a block diagram of the engine lug-down suppressing device for hydraulic work machinery according to one embodiment of the present invention. FIG. 5 is a diagram showing the relationship between a target engine rotational speed previously stored in a controller shown in FIG. 4 and a pump absorption torque. FIG. 6 is a flowchart showing a procedure performed by the controller shown in FIG. 4. FIG. 7 is a diagram showing the relationship between the characteristics of torque constant control that is performed with respect to the variable displacement hydraulic pump shown in FIG. 2 and the various pump absorption torques shown in FIG. 6.

As shown in FIGS. 2 and 4, the engine lug-down suppressing device 50 for hydraulic work machinery according to the embodiment includes a detector 51 for detecting the presence or absence of pilot pressure in the pilot circuit 31. The detector 51 includes a pressure switch 52 that is switched on to output a detection signal when a pressure equal to or greater than a set pressure set as a minimum pilot pressure required for switching the directional control valve 30 is applied, and a shuttle valve 53 that includes two inlet ports connected to the pilot lines 37 and 38 and a single outlet port, the outlet port being connected to the pressure switch 52. In the detector 51 configured in this manner, when pilot pressure is produced by the pressure reducing valve 32 or 33 in response to the tilting of the operating lever 34*a*, the pressure switch 52 is switched on.

As shown in FIGS. 2 and 3, the engine lug-down suppressing device 50 includes a solenoid valve 54 as a control valve capable of controlling pressure in the rod-side chamber 26*a* of the tilting control unit 25. The solenoid valve 54 is interposed between the primary pressure line 36 and the rod-side chamber 26*a* so as to allow supply of pressure in the primary pressure line 36 to the rod-side chamber 26*a*, and release of pressure from the rod-side chamber 26*a* to a hydraulic oil tank 39.

The solenoid valve 54 shown in FIG. 3 is in a non-operating state in which drive current is not supplied to the solenoid valve 54. In this state, the rod-side chamber 26*a* communicates with the hydraulic oil tank 39, and therefore there is tank pressure in the rod-side chamber 26*a*, so that the piston 27 is likely to be urged by the biasing spring 28 to move in a direction to decrease the tilt angle of the swash plate 24, that is, in the displacement decreasing direction. When the solenoid valve 54 is in an operating state (not shown) in which drive current is supplied to the solenoid valve 54, pressure in the primary pressure line 36 is introduced into the rod-side chamber 26*a*, so that the piston 27 is likely to move against the biasing spring 28 in a direction to increase the tilt angle of the swash plate 24, that is, in the displacement increasing direction.

The engine lug-down suppressing device 50 includes a controller 55 for controlling the drive current to be supplied to the solenoid valve 54. The controller 55 includes a CPU, a ROM, a RAM, and an I/O interface, and performs arithmetic operations and signal input-output operations by using computer programs prestored in the ROM. A target engine rotational speed signal corresponding to the target engine rotational speed output by the input unit 40, and a detection signal output by the pressure switch 52 are input into the controller 55.

The controller 55 is set to serve as operation determining means for determining whether the operating lever device 34 is in the operated or non-operated state. More specifically, the controller 55 is set to determine that when no detection signal is provided by the pressure switch 52, the operating lever device 34 is in the non-operated state, and that when a detection signal is provided, the operating lever device 34 is in the operated state. This controller 55 and the detector 51 described above constitute detection means for detecting the presence or absence of an instruction from the operating lever device (operation instruction means) 34.

The solenoid valve 54 and the controller 55 constitute pump absorption torque control means for controlling pump absorption torque of the variable displacement hydraulic pump 23. Also, when the controller 55 determines, as the operation determining means, that the operating lever device 34 is in the non-operated state, in other words, when no instruction to cause the arm cylinder 12 to operate is detected, the controller 55 is set to serve as first valve control means for controlling drive current of the solenoid valve 54. Thus, the pump absorption torque control means (the solenoid valve 54 and the controller 55) serves as first control means for controlling pump absorption torque in accordance with the target engine rotational speed. On the other hand, when the controller 55 determines, as the operation determining means, that the operating lever device 34 is in the operated state, in other words, when an instruction to cause the arm cylinder 12 to operate is detected, the controller 55 is set to serve as second valve control means for controlling the drive current of the solenoid valve 54. Thus, the pump absorption torque control means (the solenoid valve 54 and the controller 55) serves as second control means for controlling pump absorption torque in accordance with the target engine rotational speed.

A description will be given of the characteristics of the pump absorption torque (hereinafter referred to as "non-operating-time pump absorption torque T1") controlled by the first control means when no instruction to cause the arm cylinder 12 to operate is detected, that is, when the operating lever device 34 is non-operated.

As shown in FIG. 5, when a target engine rotational speed N is in a range of $0 \leq N \leq N11$, the non-operating-time pump absorption torque T1 has a minimum value T1min, regardless of changes in the target engine rotational speed N. Furthermore, when the target engine rotational speed N is in a range of $N11 < N \leq N12$, the non-operating-time pump absorption torque T1 is proportional to the target engine rotational speed N. In addition, when the target engine rotational speed N is in a range of $N12 < N \leq N13$, the non-operating-time pump absorption torque T1 has a constant value T1mid (>T1min), regardless of changes in the target engine rotational speed N. Moreover, when the target engine rotational speed N is in a range of $N13 < N \leq N14$, the non-operating-time pump absorption torque T1 is proportional to the target engine rotational speed N. Additionally, when the target engine rotational speed N is in a range of $N14 < N$, the non-operating-time pump absorption torque T1 has a maximum value T1max (>T1mid), regardless of changes in the target engine rotational speed N.

A description will be given of the characteristics of the pump absorption torque (hereinafter referred to as "operating-time pump absorption torque T2") controlled by the second control means when an instruction to cause the arm cylinder 12 to operate is detected, that is, when the operating lever device 34 is operated.

The operating-time pump absorption torque T2 is set within a range smaller than a rated engine output torque. The characteristic line of the operating-time pump absorption torque T2 has a geometrically simplified form of a rated engine output torque characteristic line. Also, when the target engine rotational speed N is in a range of $0 \leq N \leq N21$, $N21 < N11$, the operating-time pump absorption torque T2 has a minimum value T2min (>T1min) larger than that of the non-operating-time pump absorption torque T1, regardless of changes in the target engine rotational speed N. Furthermore, when the target engine rotational speed N is in a range of $N21 < N \leq N22$, the operating-time pump absorption torque T2 is proportional to the target engine rotational speed N, and has a value larger than that of the non-operating-time pump absorption torque T1. In addition, when the target engine rotational speed N is in a range of $N22 < N$, $N22 < N12$, the operating-time pump absorption torque T2 has a maximum value T2max (>T1max), regardless of changes in the target engine rotational speed N. The maximum value T2max corresponds to the maximum pump absorption torque of the variable displacement hydraulic pump 23.

As can be seen from the characteristics of the non-operating-time pump absorption torque T1 and the operating-time pump absorption torque T2, the non-operating-time pump absorption torque T1 determined by the first control means falls within a range equal to or smaller than the operating-time pump absorption torque T2 determined by the second control means in the entire range ($0 \leq N \leq Nb$, $Nb = Nmax$) of the target engine rotational speed N, and is set to approach the operating-time pump absorption torque T2 with an increase in the target engine rotational speed N.

As shown in FIGS. 2 and 4, the engine lug-down suppressing device 50 includes a water temperature sensor 56 as water temperature detecting means for detecting the temperature of engine cooling water for cooling the engine 21, and an oil temperature sensor 57 for detecting the temperature of working oil to serve as discharge oil of the variable displacement hydraulic pump 23. The water temperature sensor 56 outputs a water temperature detection signal corresponding to a detection value, and the water temperature detection signal is input into the controller 55. The oil temperature sensor 57 outputs an oil temperature detection signal corresponding to a detection value, and the oil temperature detection signal is also input into the controller 55.

The controller 55 is set to serve as third valve control means for controlling drive current of the solenoid valve 54 based on the water temperature detection signals and the oil temperature detection signals. Thus, the pump absorption torque control means serves as correction means for correcting the non-operating-time pump absorption torque T1 determined by the first control means. The correction means performs correction to reduce the non-operating-time pump absorption torque T1 when the temperature of the engine cooling water is greater than a preset threshold value and when the temperature of the working oil is greater than a preset threshold value. With regard to the characteristics of the pump absorption torque (hereinafter referred to as "correction pump absorption torque T1'") corrected by the correction means, for example, the correction pump absorption torque T1' is set with the characteristic line described in a form similar to the non-operating-time pump absorption torque T1 and is also set to a value smaller than that of the non-operating-time pump absorption torque T1. The threshold value of the temperature of the engine cooling water is set to a value within a temperature range in which the engine 21 is heated to a temperature sufficient to produce the rated engine output torque. The threshold value of the temperature of the working oil is set to a value within a temperature range sufficient to provide the viscosity of the working oil suitable for the operation of the variable displacement hydraulic pump 23.

The engine lug-down suppressing device 50 according to the embodiment as configured in this manner operates as follows.

As shown in FIG. 6, the controller 55 firstly receives input of a target engine rotational speed signal from the input unit 40, a water temperature detection signal from the water temperature sensor 56, and an oil temperature detection signal from the oil temperature sensor 57 (step S1). And then the controller 55 determines, on the basis of whether or not a detection signal is provided by the pressure switch 52, whether the pressure switch 52 is on or off, that is, whether the operating lever device 34 is in the operated or non-operated state (step S2). If it is determined that the operating lever device 34 is in the non-operated state, the controller 55 serves as the first valve control means to calculate the non-operating-time pump absorption torque T1 as a pump absorption torque T (step S3). At this time, if both of the temperature of engine cooling water obtained from the water temperature detection signal and the temperature of working oil obtained from the oil temperature detection signal are greater than the respective threshold values, the controller 55 controls the drive current of the solenoid valve 54, that is, the tilt angle (displacement) of the swash plate 24, in accordance with the target engine rotational speed N so as to obtain the non-operating-time pump absorption torque T1 as the pump absorption torque T (step S4, step S5, and step S6). In other words, the solenoid valve 54 and the controller 55 serve as the first control means. After that, as long as the operating lever device 34 is in the non-operated state and both of the temperature of engine cooling water and the temperature of working oil are greater than the respective threshold values, the routine of steps S1 to S6 is repeated, and the solenoid valve 54 and the controller 55 are held in a state of serving as the first control means.

On the other hand, even if the operating lever device 34 is in the non-operated state, if at least one of the temperature of engine cooling water and the temperature of working oil is equal to or smaller than the corresponding threshold value, the controller 55 serves as the third valve control means, and thus the solenoid valve 54 and the controller 55 serve as the correction means. More specifically, the controller 55 controls the drive current of the solenoid valve 54, that is, the tilt angle (displacement) of the swash plate 24, in accordance with the target engine rotational speed N so as to obtain the correction pump absorption torque T1' as the pump absorption torque T (step S4 or S5, and step S7). After that, as long as the operating lever device 34 is in the non-operated state and at least one of the temperature of engine cooling water and the temperature of working oil is equal to or smaller than the corresponding threshold value, the routine of steps S1 to S4 and step S7 or the routine of steps S1 to S5 and step S7 is repeated, and the solenoid valve 54 and the controller 55 are held in a state of serving as the correction means. Furthermore, when the engine 21 and the working oil are sufficiently heated and the temperature of engine cooling water and the temperature of working oil are greater than the respective threshold values, the process goes to the state in which the above-described routine of steps S1 to S6 is repeated, that is, the state in which the solenoid valve 54 and the controller 55 serve as the first control means.

When the pressure switch 52 is switched on in response to an operation of the operating lever device 34, the controller 55 serves as the second valve control means, and thus the solenoid valve 54 and the controller 55, i.e., the pump absorption torque control means, serves as the second control means. More specifically, the controller 55 controls the drive current of the solenoid valve 54 in accordance with the target engine rotational speed N so as to obtain the operating-time pump absorption torque T2 as the pump absorption torque T (step S1, step S2, and step S8). After that, as long as the operating lever device 34 is in the operated state, the routine of steps S1, S2 and S8 is repeated, and the solenoid valve 54 and the controller 55 are held in a state of serving as the second control means.

By the foregoing operation of the controller 55, a displacement q of the variable displacement hydraulic pump 23 is controlled, and P-q characteristics of the variable displacement hydraulic pump 23 change, for example, as shown in FIG. 7.

More specifically, as shown in FIG. 5, when the target engine rotational speed N in a non-operated state of the operating lever device 34 has, for example, a value Na within a range of N12<N<N13, the non-operating-time pump absorption torque T1mid is obtained. Thus, in the non-operated state of the operating lever device 34 and at the target engine rotational speed Na, torque constant control for controlling the displacement q relative to a pump discharge pressure P is performed with the non-operating-time pump absorption torque T1mid as the upper limit of the pump absorption torque T, as shown in FIG. 7. When the operating lever device 34 is operated in this state, the operating-time pump absorption torque T2max is obtained as shown in FIG. 5. Therefore, the upper limit of the pump absorption torque T shifts from T1mid to T2max as indicated by arrow A in FIG. 7, so that the torque constant control is performed with the operating-time pump absorption torque T2max as the upper limit of the pump absorption torque T.

Furthermore, as shown in FIG. 5, when the target engine rotational speed N in a non-operated state of the operating lever device 34 has, for example, a value Nb within a range of N14<N, the non-operating-time pump absorption torque T1max is obtained. Thus, in the non-operated state of the operating lever device 34 and at the target engine rotational speed Nb, the torque constant control is performed with the non-operating-time pump absorption torque T1max as the upper limit of the pump absorption torque T, as shown in FIG. 7. When the operating lever device 34 is operated in this state, the operating-time pump absorption torque T2max is obtained as shown in FIG. 5. Therefore, the upper limit of the pump absorption torque T shifts from T1max to T2max as indicated by arrow B in FIG. 7, so that the torque constant control is performed with the operating-time pump absorption torque T2max as the upper limit of the pump absorption torque T.

In the engine lug-down suppressing device 50 according to the embodiment, it is possible to obtain the following advantageous effects.

In the engine lug-down suppressing device 50 according to the embodiment, the non-operating-time pump absorption torque T1 determined by the first control means falls within a range equal to or smaller than the operating-time pump absorption torque T2 determined by the second control means in the entire range of the target engine rotational speed N, and is set to approach the operating-time pump absorption torque T2 with an increase in the target engine rotational speed N. Thus, in a state in which the engine is operating in a range of the engine rotational speed capable of producing a sufficient engine output torque for the operating-time pump absorption torque (maximum pump absorption torque) T2max, the non-operating-time pump absorption torque T1 in a stopped state (non-operating time) of the arm cylinder 12 can be caused to approach the operating-time pump absorption torque T2 at the start of operation (operating time) of the arm cylinder 12, thereby enabling reduction of an increase in the pump discharge flow rate when the arm cylinder 12 is caused to operate quickly from the stopped state. It is therefore possible to suppress deterioration in operability of the arm cylinder 12 when the arm cylinder 12 is caused to operate quickly from the stopped state.

In the engine lug-down suppressing device 50 according to the embodiment, when the engine 21 is not heated to a temperature sufficient to produce the rated engine output torque, or when the working oil is not heated to a temperature sufficient to have the viscosity suitable for the operation of the variable displacement hydraulic pump 23, the non-operating-time pump absorption torque T1 is corrected to the correction pump absorption torque T1' so that a difference between the engine output torque and the non-operating-time pump absorption torque can be prevented from becoming too reduced.

In the engine lug-down suppressing device 50 according to the foregoing embodiment, the non-operating-time pump absorption torque T1 having the characteristics shown in FIG. 5 is used as an example of the pump absorption torque determined by the first control means. However, it should be understood that the characteristics of the pump absorption torque determined by the first control means in the present invention are not limited to those shown in FIG. 5. Any pump absorption torque may be set that fall within a range equal to or smaller than the operating-time pump absorption torque in the entire range of the target engine rotational speed N and are set to approach the operating-time pump absorption torque T2 at least in a range equal to or greater than the target engine rotational speed N22 at which the operating-time pump absorption torque T2max can be obtained.

In the description of the engine lug-down suppressing device 50 according to the foregoing embodiment, the arm cylinder 12 is used as an example of hydraulic actuators. However, this should not be considered as limiting the present invention to that the pump absorption torque control of the variable displacement hydraulic pump 23 using the pump absorption torque control means is performed with respect only to the arm cylinder 12. That is to say, the pump absorption torque control using the pump absorption torque control means may be performed in this manner with respect to the hydraulic actuators other than arm cylinder 12 such as traveling motors 10, the revolving motor, the boom cylinder 11, and the bucket cylinder 13.

In the engine lug-down suppressing device 50 according to the foregoing embodiment, the detection means for detecting the presence or absence of an instruction to cause the hydraulic actuator to operate is composed of the detector 51 for detecting the pilot pressure created by the operating lever device 34, and the controller (operation determining means) 55 set to determine, on the basis of the presence or absence of a detection signal from the pressure switch 52 of the detector 51, whether the operating lever device 34 is in the operated or non-operated state. However, the detection means according to the present invention is not limited thereto. In place of the detector 51 and the controller 55, the detection means may be composed of: detection equipment, such as a variable resistor and a potentiometer, for converting the operation of the operating lever device 34 into an electrical signal; and a controller that is set to serve as operation determining means for determining, on the basis of an electrical signal from the detection equipment, whether the operating lever device 34 is in the operated or non-operated state.

In the hydraulic excavator 1 as an example of the hydraulic work machinery according to the foregoing embodiment, the hydraulic control system 20 includes the hydraulic-pilot-operated directional control valve 30, and the operating lever device 34 for supplying pilot pressure to the directional control valve 30. Also, the engine lug-down suppressing device 50 includes the detection means including: the detector 51 having the shuttle valve 53 and the pressure switch 52; and the controller 55 set to determine, on the basis of the presence or absence of a detection signal from the pressure switch 52, whether the operating lever device 34 is in the operated or non-operated state so that the engine lug-down suppressing device 50 can be applied to the hydraulic control system 20 including the directional control valve 30 and the operating lever device 34. The engine lug-down suppressing device according to the present invention not only is applied to the hydraulic control system 20, but also is applied to a hydraulic control system including, in place of the directional control valve 30 and the operating lever device 34 in the hydraulic control system 20, an electric-operated directional control valve that switches by driving a solenoid, and an electric operating lever device that outputs an electrical signal for giving an instruction on a valve position of this directional control valve. Detection means for use in such hydraulic control system is designed to receive input of an electrical signal from the above electric operating lever device, in place of a detection signal from the pressure switch 52, and is composed of, in place of the above-described controller 55, a controller set to determine, on the basis of the electrical signal, whether the operating lever device is in the operated or non-operated state. This detection means eliminates the need for the pressure switch 52 and the shuttle valve 53.

In the engine lug-down suppressing device 50 according to the foregoing embodiment, in the controller 55, both of the correction pump absorption torque at the time when the temperature of engine cooling water is equal to or smaller than the threshold value and the correction pump absorption torque at the time when the temperature of working oil is equal to or smaller than the threshold value, are set to the same correction pump absorption torque T1'. However, the present invention is not limited to the case where the pump absorption torque is corrected in such a manner. Alternatively the correction pump absorption torque at the time when the temperature of engine cooling water is equal to or smaller than the threshold value and the correction pump absorption torque at the time when the temperature of working oil is equal to or smaller than the threshold value may be set to different correction pump absorption torques.

While the engine lug-down suppressing device 50 according to the foregoing embodiment is provided on the hydraulic excavator 1, the hydraulic work machinery provided with the present invention is not limited to hydraulic excavators, but also can include wheel loaders and backhoe loaders.

REFERENCE SIGNS LIST

1 hydraulic excavator
2 traveling body
2*a* crawler belt
3 revolving superstructure
3*a* operator's cab
3*b* machinery house
4 front working machine
5 boom
6 arm
7 bucket
10 traveling motor
11 boom cylinder
10 arm cylinder
12 bucket cylinder
20 hydraulic control system
21 engine
22 transmission
23 variable displacement hydraulic pump
24 swash plate
25 tilting control unit
26 cylinder bore
26*a* rod-side chamber

26*b* bottom-side chamber
27 piston
27*a* piston rod
28 biasing spring
30 directional control valve
30*a* hydraulic pilot portion
30*b* hydraulic pilot portion
31 pilot circuit
32, 33 pressure reducing valve
34 operating lever device
34*a* operating lever
35 pilot pump
36 primary pressure line
37, 38 pilot line
39 hydraulic oil tank
40 input unit
50 engine lug-down suppressing device
51 detector
52 pressure switch
53 shuttle valve
54 solenoid valve
55 controller
56 water temperature sensor
57 oil temperature sensor

The invention claimed is:

1. An engine lug-down suppressing device for hydraulic work machinery, provided on the hydraulic work machinery including: an engine; a variable displacement hydraulic pump that is driven by the engine; a hydraulic actuator that is driven by discharge oil of the variable displacement hydraulic pump; an operation instruction circuit for giving an instruction to cause the hydraulic actuator to operate; and a target engine rotational speed instruction input unit for giving an instruction on a target engine rotational speed of the engine, the engine lug-down suppressing device comprising: a detection controller for detecting the presence or absence of an instruction by the operation instruction circuit; and a pump absorption torque controller for controlling pump absorption torque of the variable displacement hydraulic pump in accordance with a detection result by the detection controller, wherein the pump absorption torque controller is operatively configured to serve as a: first controller for controlling pump absorption torque in accordance with the target engine rotational speed when no instruction is detected by the detection controller; and a second controller for controlling pump absorption torque in accordance with the target engine rotational speed when an instruction is detected by the detection controller, and wherein the pump absorption torque determined by the first controller falls within a range equal to or smaller than the pump absorption torque determined by the second controller in an entire range of the target engine rotational speed, and is set to approach the pump absorption torque determined by the second controller with an increase in the target engine rotational speed.

2. The engine lug-down suppressing device for the hydraulic work machinery according to claim 1, comprising:

a water temperature sensor for detecting temperature of engine cooling water for cooling the engine; and a correction controller for correcting the pump absorption torque determined by the first controller in accordance with the engine cooling water temperature detected by the water temperature sensor.

3. The engine lug-down suppressing device for the hydraulic work machinery according to claim 1, comprising:

an oil temperature sensor for detecting temperature of working oil to serve as discharge oil of the variable displacement hydraulic pump; and a correction controller for correcting the pump absorption torque determined by the first controller in accordance with the working oil temperature detected by the oil temperature sensor.

4. The engine lug-down suppressing device for the hydraulic work machinery according to claim 2, comprising:

an oil temperature sensor for detecting temperature of working oil to serve as discharge oil of the variable displacement hydraulic pump; and a correction controller for correcting the pump absorption torque determined by the first controller in accordance with the working oil temperature detected by the oil temperature sensor.

* * * * *